US005509792A

United States Patent [19]

Sullivan et al.

[11] Patent Number: 5,509,792

[45] Date of Patent: Apr. 23, 1996

[54] ELECTROMAGNETICALLY DRIVEN RECIPROCATING PUMP WITH FLUTED PISTON

[75] Inventors: Paul J. Sullivan, Plymouth; Vernon R. Scott, Eden Prairie; Robert Smith, Brooklyn Park, all of Minn.

[73] Assignee: Pumpworks, Inc., Plymouth, Minn.

[21] Appl. No.: 394,890

[22] Filed: Feb. 27, 1995

[51] Int. Cl.[6] ..... F04B 17/04

[52] U.S. Cl. ..... 417/417; 417/555.1; 417/557; 417/566; 92/85 R; 92/162 P

[58] Field of Search ..... 417/417, 555.1, 417/557, 566, 569; 92/85 R, 162 R, 162 P

[56] References Cited

U.S. PATENT DOCUMENTS

| | | | |
|---|---|---|---|
| 2,515,110 | 7/1950 | Bornstein | 417/566 |
| 3,023,708 | 3/1962 | Thiele | 417/240 |
| 3,554,375 | 1/1970 | Willinger | 210/169 |
| 3,751,188 | 8/1973 | Willinger et al. | 417/417 |
| 4,211,150 | 7/1980 | Framberg | 92/85 R |
| 4,775,301 | 10/1988 | Cartwright et al. | 417/417 |
| 5,085,563 | 2/1992 | Collins et al. | 417/417 |

FOREIGN PATENT DOCUMENTS

| | | | |
|---|---|---|---|
| 2410072 | 9/1975 | Germany | 417/417 |
| 1504 | 1/1977 | Japan | 417/417 |

*Primary Examiner*—Richard A. Bertsch
*Assistant Examiner*—Roland G. McAndrews, Jr.
*Attorney, Agent, or Firm*—Leo Gregory

[57] ABSTRACT

A reciprocal type of pump structure wherein a piston has a linear function actuated by a pair of coils energized alternately and includes a plurality of tapered flutes. A check valve in an outlet of the structure which stretches to open said outlet under the impact of expelled fluids and of its own volition retracts to the closed position immediately upon the cessation of fluids being expelled.

11 Claims, 4 Drawing Sheets

ELECTROMAGNETICALLY DRIVEN RECIPROCATING PUMP WITH FLUTED PISTON

BACKGROUND OF THE INVENTION

1. Field of Invention

This invention comprises a reciprocal type pump or motor adapted to have a linear function.

2. Description of the Prior Art

The most commonly used pumps and motors appear to be adapted for rotational motion or action.

Linear acting pumps are in use and these for the most part are driven by a relay which energizes a pair of spaced opposed coils. Relays operate slowly and have a relatively short life span. Other pumps use a single coil to move a plunger or piston in one direction utilizing a spring for a return. Springs are subject to fatigue and are not controllable for variable pressure.

Conventional seals are used in connection with the housings and internal parts of pumps or motors generally and these are subject to deterioration and in time require replacement. Such seals do not assure that a pump housing will be leakproof particularly in pumping exotic or dangerous fluids.

SUMMARY OF THE INVENTION

The present invention relates to a device comprising a linear acting pump or motor which includes a piston or plunger adjacent a pair of opposed coils each being activated independently of the other by a silicon controlled rectifier. The coils upon becoming energized actuate the piston being used in a pump or motor action to provide variable pressure or thrust at a desired stroke speed, the same being controlled by a solid state circuit.

A principal advantage of the device is present in its simplicity of structure particularly in having a sealless housing and has no internal seals with respect to the parts therein. The assembled parts of the housing are secured by a weld seam which renders the housing to be absolutely leakproof whereby it can safely pump both exotic and dangerous fluids.

In the Collins U.S. Pat. No. 5,085,563, it is stated that there is an absence of any seals in the motor or pump. No reference is made to the housing. The assembled parts of the housing appear to be secured by a tight fit and this does not assure a leakproof housing. This is a significant difference from the housing structure of the invention. The housing of the invention is submersible and can operate normally submerged in a body of water. The Collins structure would not appear to be adapted for a submersible operation.

In the Collins patent there is a bore through the plunger to provide a passage for fluid through the pump structure.

The piston of the pump of the invention herein has a plurality of longitudinally extending flutes thereabout which are tapered decreasing from the inlet end of the pump in the direction of the outlet end of the pump wherein internally of said pump fluid accumulates ahead of the piston on the reverse stroke thereof and the accumulated fluid is positively displaced by the impact of the piston on its forward discharge stroke. This represents a significant difference in structure from what is present in the Collins patent.

Other features and advantages will become apparent to those skilled in the art upon reviewing the drawings and the detailed description disclosing the invention followed by the appended claims.

DESCRIPTION OF A PREFERRED EMBODIMENT

Figure 1:
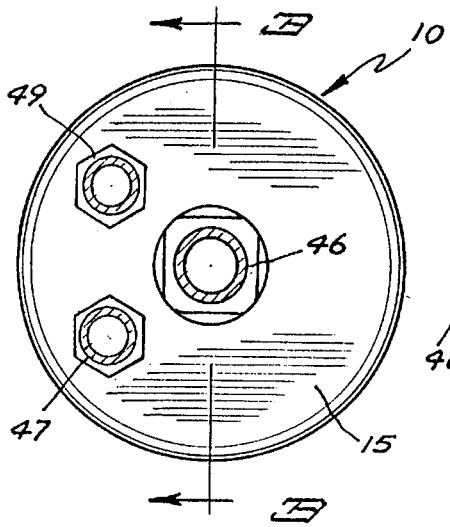
FIG. 1 is an end view in elevation of the outer housing.
Figure 2:
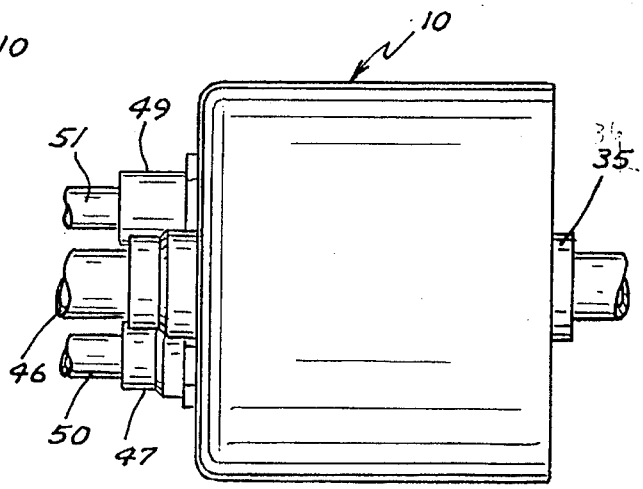
FIG. 2 is a side elevational view of the outer housing in side elevation.
Figure 3:
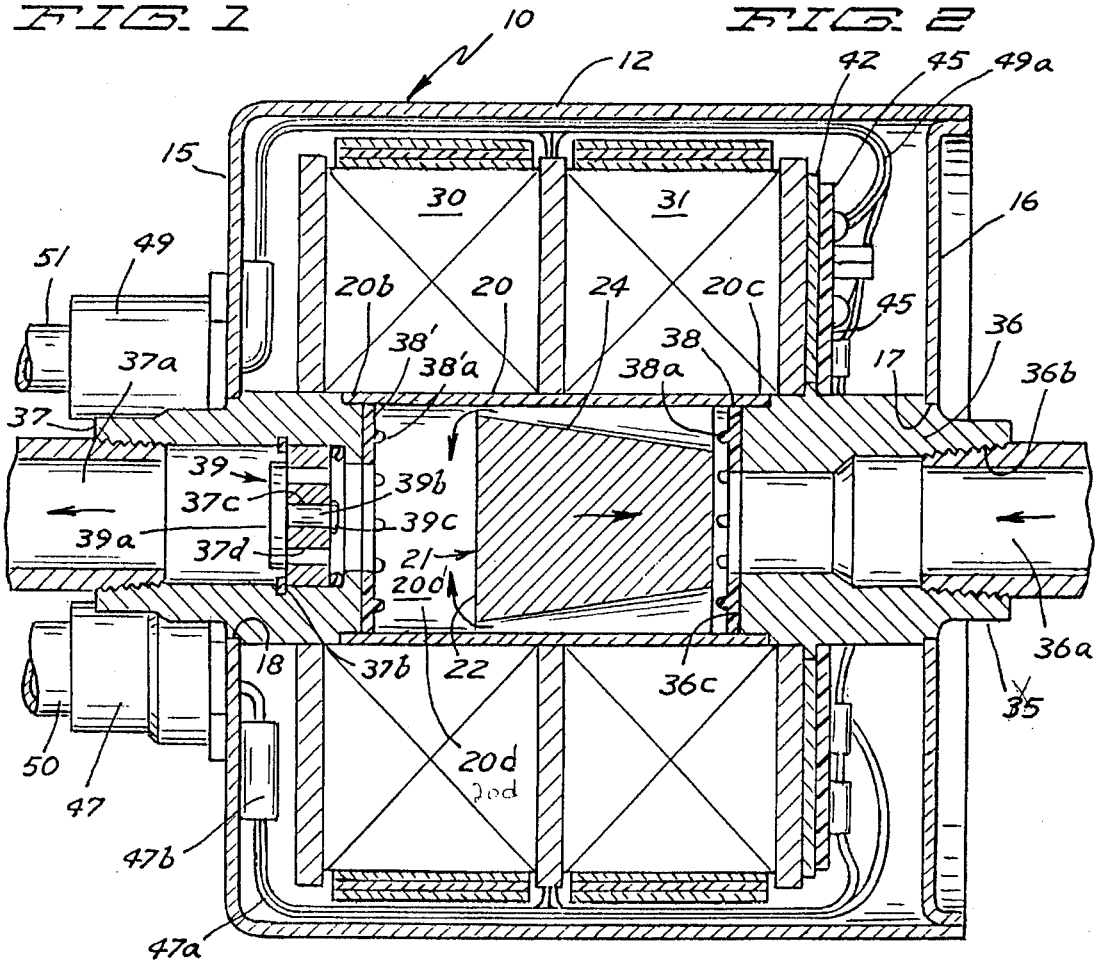
FIG. 3 is a view in longitudinal section taken on line 3—3 of FIG. 1 as indicated.
Figure 4:
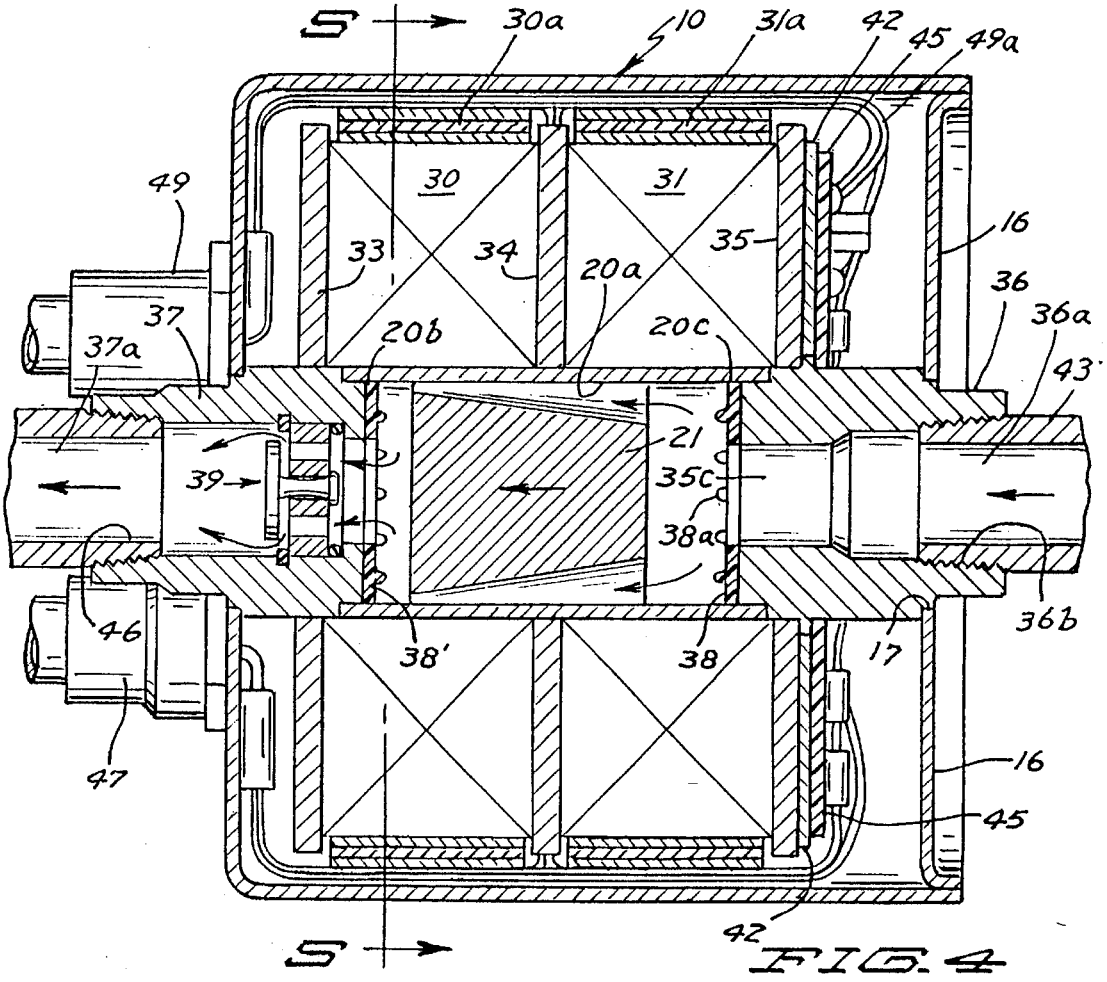
FIG. 4 is a view similar to that of FIG. 3 showing a reversal of an internal operation.
Figure 5:
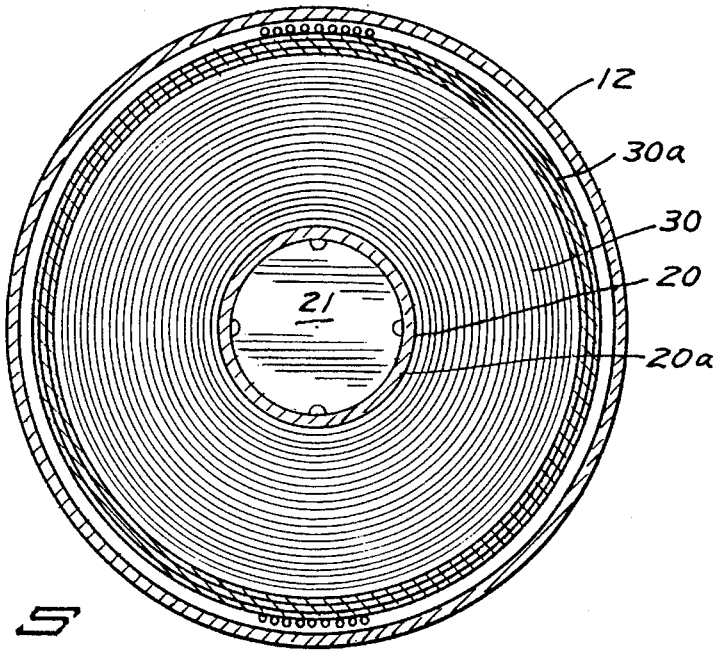
FIG. 5 is a view in cross section taken on line 5 of FIG. 4.

Referring to the drawings and particularly to FIGS. 2–4, the pump-motor device of the invention herein is indicated generally by the reference numeral 10 comprising an outer cylindrical housing 12 having end walls 15 and 16, said end walls having circular central openings 17 and 18 therein. The end wall 15 is integral with said housing and said end wall 16 is secured to said housing as will be described.

The device herein is not limited as to size. The size indicated herein for purpose of illustration is a commonly used size for the device herein, it having a length on the order of three inches and a diameter on the order of three and one fourth inches. The smallness of its size and its simplicity of structure are salient features.

Disposed to be centrally longitudinally positioned within said outer housing is an inner tubular piston housing 20 which as an illustrated example is shown to be on the order of two and one fourth inches in length and seven eighths inches in diameter. Said piston housing is magnetically non-conductive as is said housing 12.

Within said inner housing 20 for reciprocal movement therein is a magnetically permeable cylindrical piston 21 having an outlet end 22, an inlet end 23 and an outer wall 24. Said piston is diametrically sized to have a precise fit within said piston housing 20 with the allowance of just sufficient clearance to permit reciprocal movement of said piston.

Formed about said outer wall of said piston and extending longitudinally thereof are a plurality of tapered flutes 26 (FIGS. 6 and 7) having their larger ends **26*a* at the inlet end of said piston, said flutes tapering as at 26*b* at the outlet end of said piston leaving just sufficient clearance at the outlet end for the passage of fluid between the flutes and the inner wall 20*a*** of said piston housing.

Disposed about said piston housing are a pair of opposed coils 30 and 31. The coil 30 is referred to as the power coil moving the piston toward the outlet passage and the coil 31 is referred to as the reset coil retracting the piston to a reset position for its next movement forward towards the outlet as will be described.

Respectively forming wraps **30*a* and 31*a* about each of the circumferences of the coils 30 and 31 are a plurality of layers of thin magnetically conductive strip material. Disposed between and overlying the outer side of each of said coils respectively are conductive washers 33, 34 and 35** each having a diameter such as to have a good contact with said wraps about said coils.

Conductors 30*b, c* and 31*b, c* extend outwardly from each of said coils to become part of a circuitry to be described. Although not shown, said washers each have a slot for the extensions of said conductors therethrough.

Referring now to the tubular housing 20, the same has ends 20*b* and 20*c*. Welded to said end 20*c* is an inlet plug 36 and welded to said end 20*b* is an outlet plug 37.

The inlet plug 36 is cylindrical having therethrough a passage 36*a* and having an outer internally threaded end portion 36*b*. As illustrated, said plug is partially inserted into said end 20*c* of said housing 20 being welded thereto forming a leakproof connection. Disposed against the face 36*c* of said plug 36 internally of said housing is a ring like washer 38 having spaced thereabout in facing inwardly of said housing 20 radial projections 38*a*, the purpose of the same being to absorb the impact of the piston 21 in its reciprocal movement as will be further described.

Figure 9:
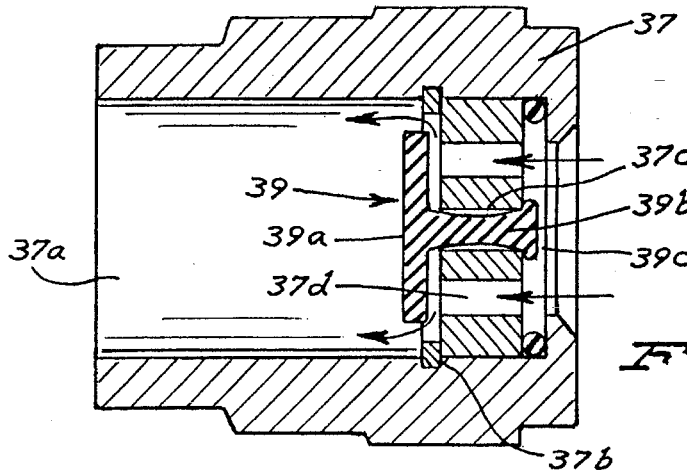
FIG. 9 is an enlarged view in longitudinal section of the check valve at the outlet of the device.

Welded in like manner to the outlet end 20*b* of said tubular housing is said outlet plug 37 having a passage 37*a* therethrough. Said passage has a wall 37*b* therein which has a center or central opening or passage 37*c* with a plurality of passages thereabout as indicated at 37*d*. Disposed into said wall and secured in said central opening is a check valve 39. Said check valve has a face portion 39*a* exteriorly of said wall 37*b* adapted to overlie the same and spaced inwardly of said wall on a stem 39*b* of said valve is a hub 39*c* somewhat larger than said central opening 37*c* and being positioned at the inner side of said wall 37*b* said stem being extensible or stretchable to provide longitudinal movement under the impact of fluid pressure whereby the check valve has longitudinal movement to open and allow or stop the passage of fluid through said wall 37*b* in accordance with the pressure of an expelled fluid. This action will be further described. This is shown in FIG. 9 with the stem becoming thinner as it is stretched by pressure of expelled fluids to open the valve.

Overlying the inner face of said wall 37*b* is a ring like washer 38' identical with said washer 38 and likewise is adapted to absorb or cushion the impact of the piston 21 in its reciprocating action.

In being placed in operating position on said inner housing 20, the washer 34 is disposed between the coils and the washers 33 and 35, as has been said, are at the outer sides of the coils. The coils are of such a width that the washers 34 and 35 extend over the ends of the housing 20 and have their centers disposed about the adjacent portions of said outlet and inlet plugs 36 and 37 fitting snugly about said plugs for good contact and said plugs are conductive although said housing 20 is not.

Overlying the outer side of said coil 31 is the washer 35 and overlying the outer side of said washer is a mylar washer 42 which is non-conductive. Overlying said mylar washer is a circular circuit board 45 and outwardly thereof is the end wall 16 which is welded to the housing 20 and the central opening 17 therein is welded to the inlet plug 36 for a fluid tight closure.

When in operation, threaded into said inlet plug 36 will be a supply tube such as tube 43 and in like manner an outlet tube or pipe 46 will be threaded into said outlet plug 37. The connection with said inlet and outlet tubes will be leakproof.

It will be noted that the end wall 15 has mounted thereon external male and female connectors 47 and 49, the same by the internal conductors 47*a* and 49*a* being in circuit with the circuit board 45. In connection with the conductor 47*a* is a conventional heat sensor 47*b* to shut off current in the case of excessive heating.

In attachment with said connectors and running to a direct current power source are conductors 50 and 51, the connections, of the same being fluid tight.

Described now will be the circuitry of the device herein and in connection therewith a description is given of the operation of the device. The elements of the circuit and their functions are conventional and known in the art. What is unique is their particular arrangement and association resulting in the operation to be described.

Figures 6, 7, 8:
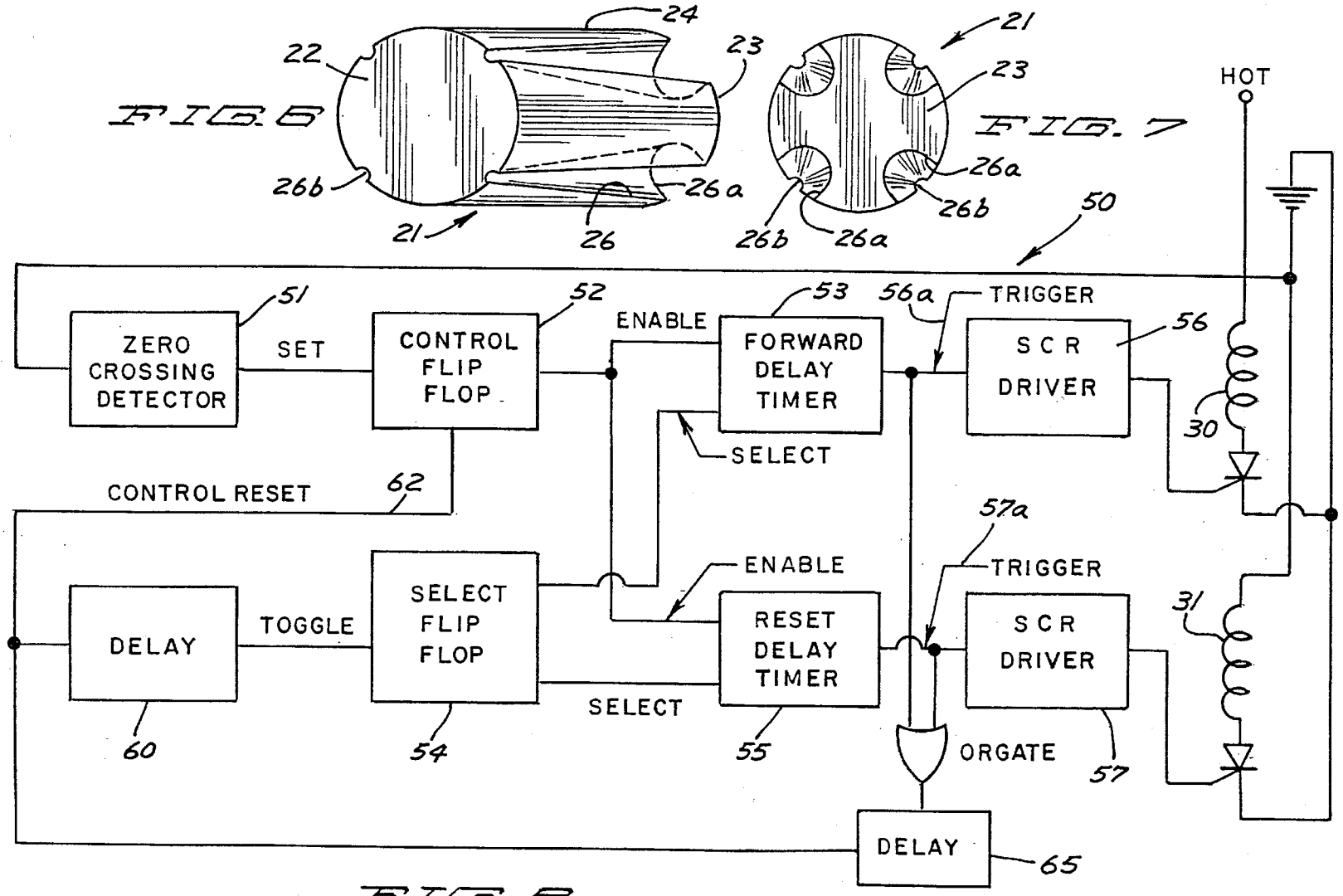
FIG. 6 is a view in end elevation of the tapered end of the piston.
FIG. 7 is a view in end elevation of the tapered end of the piston.
FIG. 8 is a block wiring diagram.

The circuitry is a solid state circuit 50 as shown in the block diagram of FIG. 8. The circuitry is adapted to alternately energize the two coils indicated at 30 and 31 to reciprocate the piston 21 within the tubular housing 20 when the line voltage crosses from negative to positive, the power or current being turned on though a switch is not here shown. The zero crossing detector 51 in operating as a sensor sets the control flip flop 52 starting the timer 53 selected by the select flip flop 54. At the end of the timing period the selected SCR 56 or 57 (silicon controlled rectifier) driver circuit is triggered causing the selected SCR to turn on. The corresponding SCR triggering signal 56*a* or 57*a* is also delayed by delay 65 and fed back into the control reset circuit 62 to reset the corresponding control flip flop 52 or 54 and corresponding timer 53 or 55 and to toggle at 64 the select flip flop 52 or 54 causing the opposite timer, the corresponding SCR and corresponding coil 30 or 31 to operate in the following described cycle.

When an SCR is turned on, this being the switch for a coil, the current in the selected coil increases until the line voltage crosses from positive to negative. A negative line voltage causes the coil current to decrease until it reaches zero at which point the SCR turns off preventing any further current flow through the coil.

Referring to FIGS. 3 and 8, the piston is shown in its reset position at the completion of the reset coil pulse. In this position the forward or power coil 30 is fired causing magnetic flux to be present in the closed loop consisting of the piston 21, washer 34, wrapping 30*a*, washer 33, outlet plug 37 and the gap or space 20*d* between the piston and the outlet plug 37. The magnetic flux in the gap 20*d* develops a force on the piston accelerating it toward the outlet plug 37. This puts the fluid in the gap under the pressure causing the outlet check valve 39 to stretch open, the fluid ahead of the piston is expelled through said check valve in the outlet plug 37 until the piston reaches its forward position engaging the compressible washer 38'. The forward motion of the piston also causes fluid to become drawn behind it through the inlet passage 36*b* into the tubular housing 20.

In the forward position, the reset coil 31 is energized in a manner similar to that described for the forward stroke of the power coil 30, the piston moves rearwardly to the reset position removing fluid pressure from the check valve in the outlet plug causing its instant closing and draws fluid forwardly around the piston to fill the volume or space vacated by the reset movement of the piston. When the piston reaches the reset position, an entire pumping cycle has been completed.

A word about the check valve 39. The presence of fluid pressure causes the check valve to stretch forwardly to open for the passage therethrough of fluid and the instant the pressure of fluid is abated, the check valve snaps to its closed position of its own volition. This is an exceedingly quick valve closing and this is very important in dealing with the passage of expensive and exotic fluids where even a few drops can represent significant value.

MODIFICATION

Figure 10:
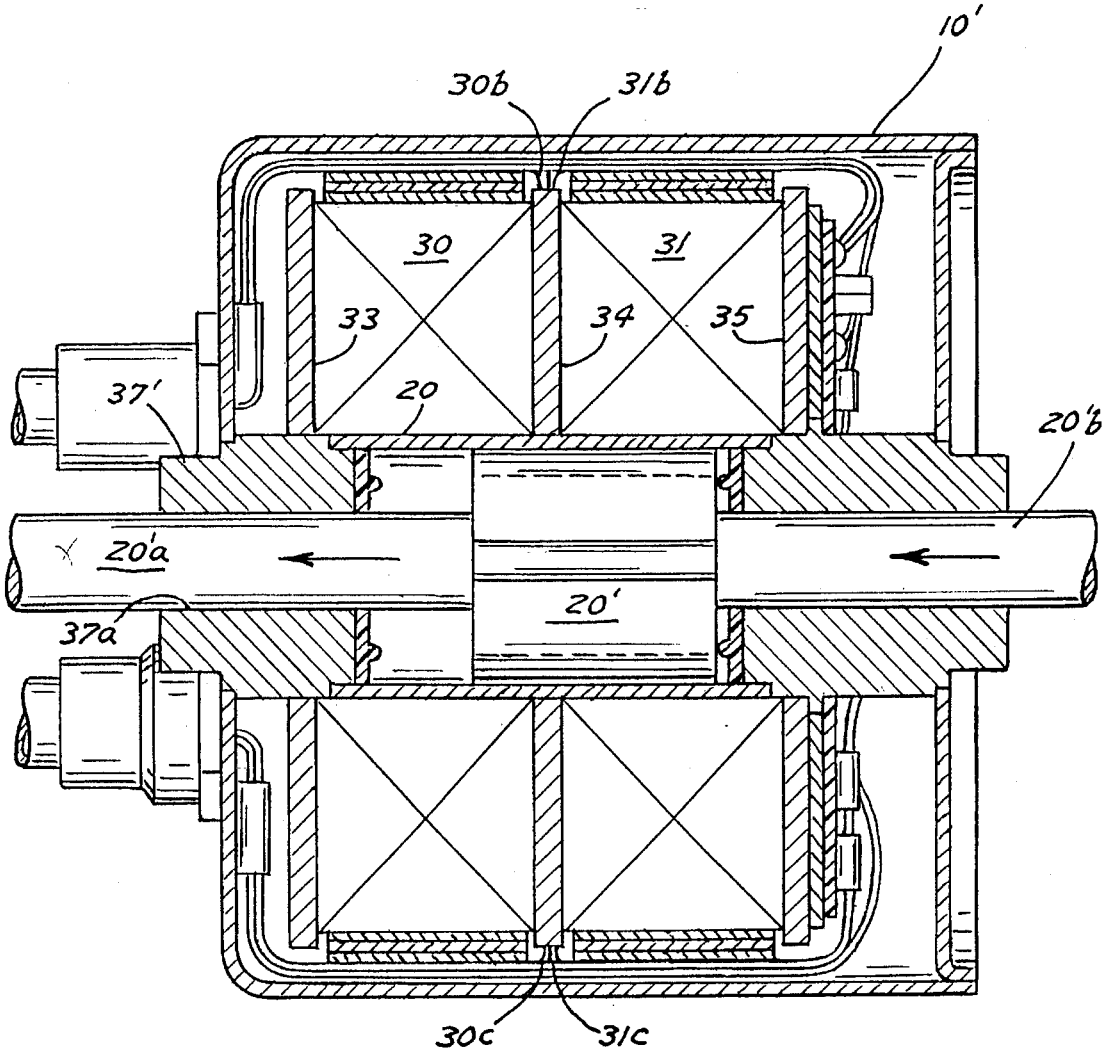
FIG. 10 is a view in longitudinal section of the device showing its conversion to a motor with outward extension from the piston.

With reference to FIG. 10, a modification is shown in the device 10 with its conversion from a pump to a motor and in its converted form it is indicated generally as 10'. The entire device is as above described except as herein changed.

In no longer expelling fluids, the piston indicated as 20' is shown having smooth side walls with just sufficient clearance to reciprocate within said tubular housing 20. The outlet plug 37 has been replaced by a plug 37' which as in the case of the inlet plug has a clear passage 37'*a* therethrough.

Removably secured to each end of said piston 20' are connecting rods 20'*a* and 20'*b* which reciprocate with said piston. The coils 30 and 31 as described create a flux path when energized as described and the magnetic flux develops a force alternately at each end in the gap of the housing 20 as the piston is alternately reciprocated by the respective coils.

The device as a motor performs a variety of tasks and the reciprocal motion by suitable external connection not shown may perform tasks requiring rotary motion.

It will of course be understood that various changes may be made in the form, details, arrangement and proportions of the parts without departing from the scope of the invention, which generally stated, consists in an apparatus capable of carrying out the objects above set forth, in the parts and combination of parts disclosed and defined in the appended claims.

What is claimed is:

1. A linear reciprocating device adapted to operate as a pump, comprising a tubular housing, a magnetically conductive cylindrical piston disposed in said housing, said housing having an inlet and an outlet including a check valve, said piston having an inlet facing end and an outlet facing end, a power coil mounted onto said housing adapted to attract and move said piston toward said outlet, a reset coil mounted onto said housing adjacent said power coil adapted to attract and move said piston toward said inlet, said piston having clearance within said housing to have reciprocal movement therein, said piston having a plurality of flutes thereabout tapered from the inlet facing end of said piston to the outlet facing end thereof having clearance at said outlet facing end to permit the passage of fluid thereby, a circuit connected to an appropriate power source alternately energizing said coils to cause the reciprocal movement of said piston, and a housing having said tubular housing, piston and coils disposed therein.

2. The structure of claim 1, wherein said inlet of said housing having a passage therethrough, and said outlet of said housing having said check valve therein which stretches open under pressure of a fluid being expelled therethrough under the impact of the oncoming movement of said piston.

3. The structure of claim 1, wherein said piston has extensions from its end portions extending outwardly of said inlet and said outlet, and means in connection with said extensions being operated thereby.

4. The structure of claim 1, wherein magnetically conductive washers are disposed at the outer side end of each of the coils and one is disposed therebetween, and said inlet and said outlet comprise conductive plugs, said washers at the outer sides of said coils having engagement with said inlet and outlet plugs in overlying the same to define a flux path therewith.

5. The structure of claim 1, wherein said inlet and said outlet comprise plugs, said inlet having a clear passage therethrough, said outlet having an extensible check valve therein yielding to be opened by the pressure of fluid passing therethrough and retracting to a closed position by action of said reset coil withdrawing said piston and fluid pressure away therefrom.

6. The structure of claim 1, wherein said check valve having a stem extensibly yielding to the pressure of expelled fluid to open position and retracting to closed position upon cessation of said fluid pressure.

7. The structure of claim 1, wherein said circuit includes a sensor opening said circuit when an upper limit heating of said device is sensed.

8. The structure of claim 1, wherein a plurality of layers conductive strip material wrapped about the radial perimeter of each of said coils.

9. The structure of claim 1, wherein said outer housing having the perimeter of a separable end wall welded thereto in an endless seam and said inlet and outlet ends thereof respectively having plugs welded thereto forming leak proof connections.

10. A linear reciprocating device operating as a pump, having in combination a tubular housing having an interior wall surface, a magnetically conductive piston disposed in said housing, said housing having respective ends respectively having an inlet and an outlet.

a power coil mounted onto said housing causing said piston to move in the direction of said outlet and in its forward position a reset coil is energized, said reset coil mounted onto said housing upon being energized causes said piston to be drawn rearwardly in the direction of said inlet, said outlet having an extensible yielding check valve, said piston having ends respectively facing said inlet and said outlet and having clearance for longitudinal movement within said housing, a plurality of exterior flutes about said piston tapered from said inlet facing end of said piston toward its outlet facing end, the ends of said tapered flutes adjacent said outlet facing end of said piston having clearance with respect to the wall surface of said housing thereabout to permit fluid to pass therebetween, whereby as said piston is drawn toward said inlet, incoming fluid is forced through said flutes to collect in front of the outlet facing end of said piston, movement of said piston in the direction of said outlet impacts said fluid forcing the same under pressure through said outlet and the yielding extension of said check valve therein, and an external housing having said tubular housing, piston and coils disposed therein.

11. The structure of claim 10, wherein an inlet plug and an outlet plug are respectively welded to said inlet and outlet of said tubular housing, said plugs each having inner ends, a compressible washer having radial projections disposed at the inner ends of said inlet and outlet plugs, and said washers dampening the impact of said piston onto said inner ends of said inlet and said outlet plugs.

* * * * *

UNITED STATES PATENT AND TRADEMARK OFFICE

CERTIFICATE OF CORRECTION

PATENT NO. : 5,509,792
DATED : April 23, 1996
INVENTOR(S) : Paul J. Sullivan, et al.

It is certified that error appears in the above-indentified patent and that said Letters Patent is hereby corrected as shown below:

In column 4, line 6, "50" should read --48-- and "51" should read --48'--;

In column 4, line 7, the "," should be deleted; and

In column 4, line 53, "36b" should read --36a--.

In FIG. 2, "35" should be --36--, "50" should be --48--, and "51" should be --48'--.

In FIG. 3, "35" should be deleted, "50" should be --48--, and "51" should be --48'--;

In FIG. 8, "64" should be added to the "TOGGLE", the 1 cm long vertical line representing the connection between the ground and "ZERO CROSSING DETECTOR 51" should be eliminated, and a connection between "HOT" and "ZERO CROSSING DETECTOR 51" should be made.

Signed and Sealed this

Twenty-eighth Day of January, 1997

*Attest:*

Bruce Lehman

BRUCE LEHMAN

*Attesting Officer* *Commissioner of Patents and Trademarks*